United States Patent [19]

Strand, Sr.

[11] 4,284,132

[45] Aug. 18, 1981

[54] APPARATUS FOR CONDITIONING AIR

[76] Inventor: Charles A. Strand, Sr., 21800 Morley Ave., Apt. 817, Dearborn, Mich. 48124

[21] Appl. No.: 731,118

[22] Filed: Oct. 12, 1976

[51] Int. Cl.[3] ..... F28F 27/02

[52] U.S. Cl. ..... 165/103; 165/35; 137/601

[58] Field of Search ..... 165/103, 122, 135; 137/601

[56] References Cited

U.S. PATENT DOCUMENTS

| | | | |
|---|---|---|---|
| 2,613,065 | 10/1952 | Didier | 165/151 X |
| 2,884,228 | 4/1959 | Jorgensen | 165/103 X |
| 3,107,724 | 10/1963 | Horn et al. | 165/103 X |
| 3,443,588 | 5/1969 | Banko | 165/103 X |
| 3,489,204 | 1/1970 | Chaloka | 165/103 |
| 3,522,841 | 8/1970 | Papalexiou | 165/103 |
| 3,627,033 | 12/1971 | Rimgquist | 165/103 X |
| 3,978,919 | 9/1976 | Fachbach | 165/135 |

*Primary Examiner*—Samuel Scott
*Assistant Examiner*—Theophil W. Streule, Jr.
*Attorney, Agent, or Firm*—Fisher, Gerhardt, Crampton & Groh

[57] ABSTRACT

Apparatus for conditioning air of the constant volume type in which air gates are provided at the outlet ends of heat exchange passages and bypass passages to regulate the proportion of air passing through each of the pair of passages and therefore the temperature of air downstream from the air gates.

15 Claims, 6 Drawing Figures

Fig-4
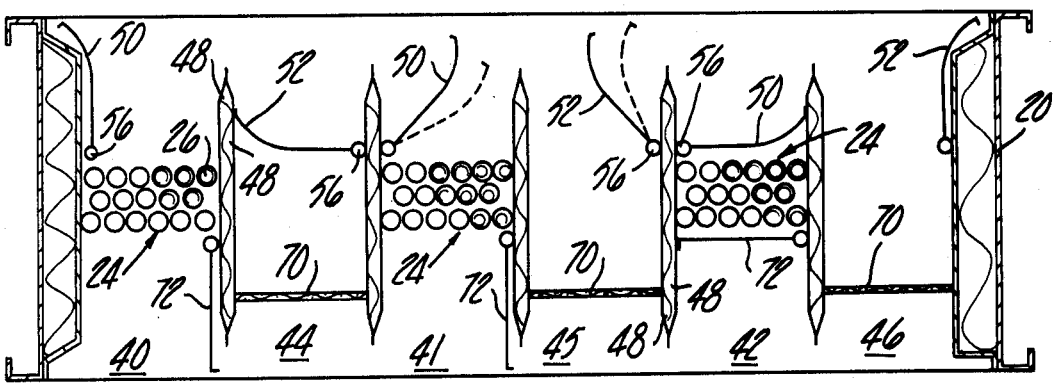
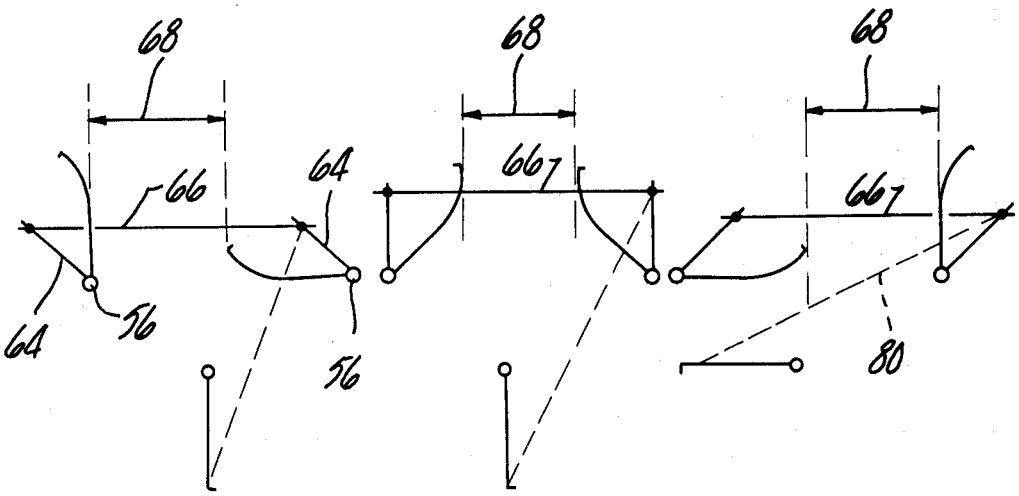
Fig-5
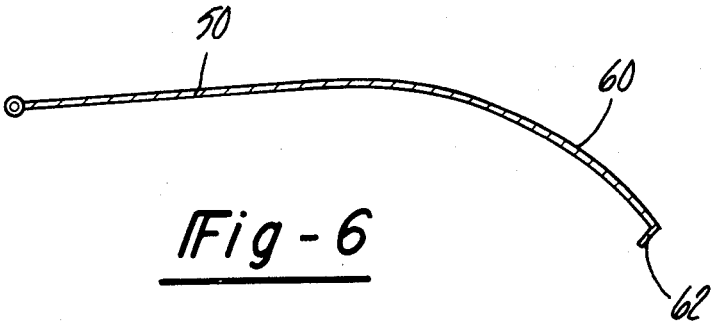
Fig-6

APPARATUS FOR CONDITIONING AIR

This invention relates to apparatus for supplying fresh heated or cooled air to a building.

Apparatus for supplying fresh heated or cooled air to buildings usually incorporate a plurality of passages, some of which contain heat exchangers and others of which allow the free passage of air. Heating or cooling medium is circulated in the heat exchangers at a selected constant temperature and by controlling dampers in heat exchange passages and the bypass passages, air is mixed and delivered at a desired temperature to the interior of the building. The dampers are manipulated to obtain the desired ratios of heated or cooled air and untreated air so that the air introduced to the buildings may be varied through the entire range between completely untreated air to one hundred percent heated or cooled air. These types of systems are frequently referred to as face and bypass systems, with face referring to the surfaces of the heat exchangers.

To properly control the temperature of the supplied air, it is highly desirable to have a uniform volume of air delivered from the heat exchange and bypass passages for any given air velocity. However, the heat exchange arrangement in the heat exchange passage offers a greater restriction to air flow than in the bypass passage making it difficult to maintain uniform air velocity in the full range of modulation. One proposal in an effort to solve this problem has been to make the bypass passage smaller in cross section than the heat exchange passage to compensate for the restriction offered by the heat exchange unit in the heat exchange passage. In this manner, an effort is made to maintain the pressure drop in the pair of passages equal so that the combined air volume remains uniform. Other attempts to solve the problem includes the use of complex controls and a multiplicity of dampers.

It is an object of the invention to provide apparatus for conditioning air which may be easily manufactured and fabricated of simple components.

It is another object of the invention to provide apparatus for conditioning air in which the adjacent heat exchange and bypass passages are controlled in such a matter that the volume of air remains constant for any given velocity of air passing through the apparatus.

Still another object of the invention is to provide an apparatus for conditioning and supplying fresh heated or cooled air in which the supply of fresh air from a pair of adjacent passages is under the control of specially formed air gates which can be moved simultaneously through equal arcs by relatively simple control mechanisms to insure that the volume of air remains constant for any given velocity of air movement.

Another object of the invention is to provide apparatus for supplying conditioned air in which the pressure drop in adjacent heat exchange and bypass passages is maintained constant.

FIG. 4 is a cross-sectional view at an enlarged scale taken on line 4—4 in FIG. 2;

FIG. 5 is a diagrammatic view of control linkage employed in controlling the apparatus seen in FIG. 4; and FIG. 6 is a cross-sectional view at an enlarged scale of one of the components used in the air treating arrangement.

Figure 1:
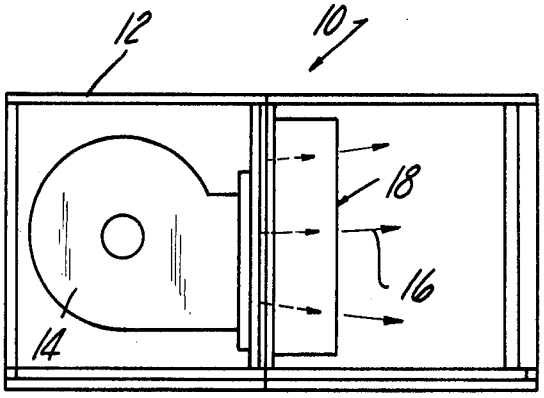
FIG. 1 is a diagrammatic view showing apparatus for conditioning air embodying the invention.
Figure 2:
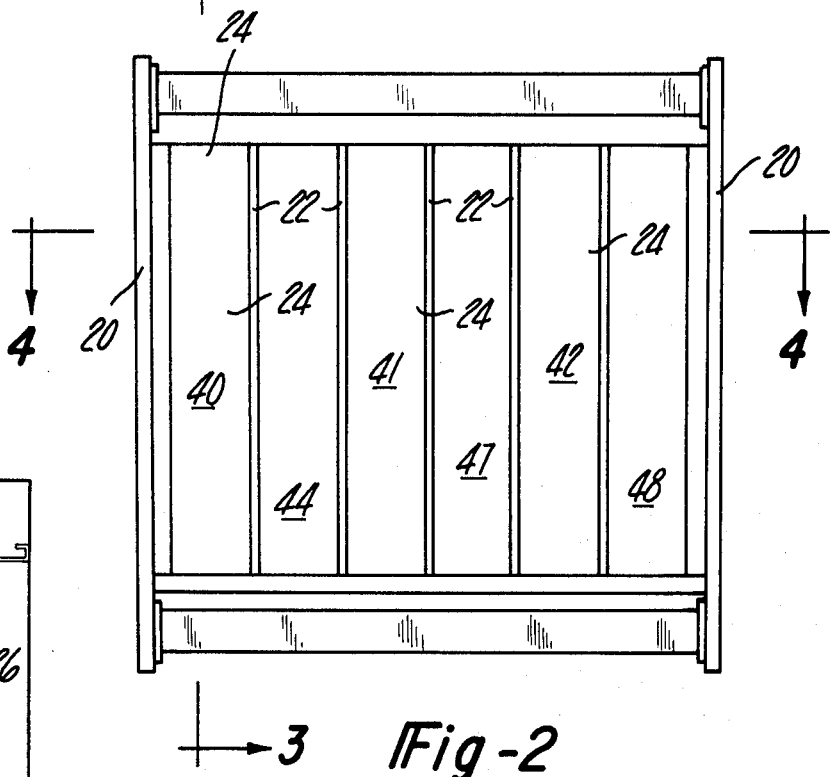
FIG. 2 is a front view of the air treating assembly in FIG. 1 but at an enlarged scale.
Figure 3:
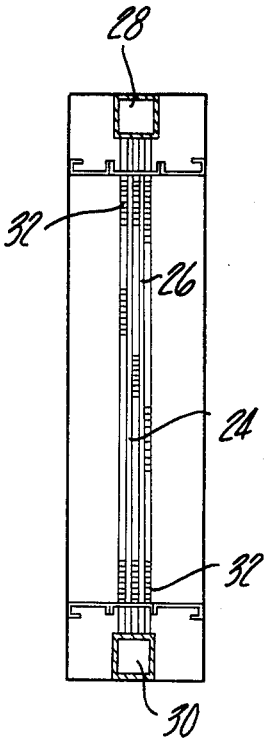
FIG. 3 is a cross-sectional view taken on line 3—3 in FIG. 2.

The apparatus for conditioning air embodying the invention is designated generally at 10 in the drawings and includes a casing 12 in which a blower 14 is disposed for directing air in the direction of the arrow 16 and through an air treating assembly 18. The air treating assembly 18 includes a pair of vertical end walls 20 and the space between the end walls is divided into a plurality of passages by vertical walls or partitions 22. Alternate ones of the passages are provided with heat exchange means 24 which may be for the purpose either of heating or of cooling. In the disclosed embodiment of the invention the heat exchange means 24 are in a form of a plurality of vertically extending steam pipes in the form of finned tubes 26. As seen in FIG. 3, the ends of the steam pipes 26 are connected at their upper ends to communicate with an inlet header 28 and at their lower ends to an outlet header 30. Steam is delivered to the inlet header 28 and is maintained at a relatively constant pressure and steam condensate is exhausted from the bottom or outlet header 30. The tubes 26 are spaced sufficiently to permit air to pass between the tubes and to be heated thereby. The tubes are provided with uniformly spaced fins 32 on their exterior to increase the heat exchange area that is exposed to passing air.

The passages containing the heat exchangers are indicated at 40, 41 and 42 and will be referred to as the heat exchange passages. The alternate passages 44, 45 and 46 adjacent to the heat exchange passages permit air to pass therethrough without being heated or cooled and are known as bypass passages. Adjacent passages 40 and 44 form one zone of the apparatus indicated at A in FIG. 4, passages 41 and 45 form another zone B and passages 42 and 46 form still another zone C. Any number of such zones may be used.

Air is delivered simultaneously to all of the passages of all of the zones by the fan or blower 14. The blower 14 is shown at the inlet side of the passages but in some arrangements a suction fan at the outlet side of the passages can be used.

The end wall 20 of the housing as well as the intermediate walls 22 forming the parallel heat exchange and bypass passages are insulated to prevent the transmission of heat. In the present arrangement the walls 22 are formed by spaced sheet metal wall plates 48 with heat insulating material disposed therebetween. The end walls 20 also are formed of spaced panels to form a cavity receiving insulating material.

Referring to FIG. 4, the outlet ends of the passages are controlled by air gates, the ones associated with the heat exchange passages 40, 41 and 42 being designated at 50 and those associated with the bypass passages 44, 45 and 46 being designated at 52. Each pair of air gates 50 and 52 are associated with a pair of adjacent passages and are supported for hinging movement about vertical hinge shafts or axes indicated at 56 adjacent to an interior wall of each of the two passages and opposite to the common wall dividing the two passages from each other.

Each gate of the pair of gates 50 and 52 is curved as indicated at 60 in FIG. 6 and is provided with an outer lip 62 so that when the gates 50 and 52 of any zone, A, B or C are moved from their open position to their closed position, the lips 62 are closely adjacent or in closed relationship to the common wall between the two passages.

The curvature of the air gates 50 and 52 is such that the convex surface faces upstream and the transverse spacing longitudinally of the passages and between the air gates 50 and 52 remains constant when the pair of gates are moved through equal arcs and in opposite directions. For this purpose the pair of air gates are linked together as seen in FIG. 5 so that when the gates 50 are in their fully open position the gates 52 are in their fully closed position and as the gates 50 are moved toward their closed position the gates 52 move toward their open position. The movement of the gates through equal angular arcs is accomplished by simple link controls diagrammatically illustrated in FIG. 5. Arms 64 associated with each gate and fixed to the shafts 56 are joined together with a tie bar 66. Each of the zones indicated at A, B and C may be controlled separately and independently by the link arrangements seen in FIG. 5. However, if desired, all of the arms 64 may be joined together for movement in unison so that the zones A, B and C are simultaneously and identically controlled.

Referring now to FIGS. 4 and 5, the curvature of the air gates is such that in any of their adjusted positions the spacing or opening therebetween and transversely to the direction of air flow remains constant for all positions of adjustment of the air gates 50 and 52. Also, as indicated by the dimensions at 68, it will be noted that the spacing between the air gates 50 and 52 is always equal to the spacing or the width of any one of the passages 40 through 46. The constant spacing is important to insure that the volume of air flow remains uniform for any given velocity of air flow. With flat gates the spacing would vary for different gate positions and result in air flow fluctuations which cannnot be accurately controlled.

The distribution of the steam pipes 22 in the heat exchange passages 40, 41 and 42 reduces the cross-sectional area of those passages so that there is a pressure drop between the inlet or upstream side and outlet or downstream side of the heat exchanger. The bypass passage is provided with a perforated plate 70 which forms an obstruction to the free passage of air and affords a pressure drop equal to that obtained in the heat exchange passages. The maintenance of equal pressure drops is necessary to insure uniform air flow through all of the passages.

The inlet side of the heat exchange passages 40, 41 and 42 or the portion of those passages upstream from the heat exchangers 24 are provided with flat air gates 72 which are hinged like a gate about vertical axis at one side of the passage for movement between their fully open position and a fully closed position. During normal operations of the apparatus the air gates 72 remain in their fully open position but on occasions when the air gates 50 associated with the heat exchange passages 40, 41 and 42 are moved to their fully closed position, the dampers 72 are moved to their closed position to isolate the heat exchange means 24. When the air gates and the dampers are closed, heat from the steam pipes 26 is prevented from affecting the air passing through the bypass passages.

The steam pipes 26 which form the heat exchange means 24 in the preferred embodiment of the invention are made up of three rows of pipes. The pipes 26 in the first row have external fins 32 spaced uniformly at a relatively wide spacing whereas the spacing of the fins on pipes in the second and third rows is relatively less. By way of example, the spacing of the fins in the first row may be to the order of five to the inch whereas the spacing in the second and third rows may be to the order of eight fins per inch. This difference in spacing is provided in an effort to maintain the rate of condensation of the steam relatively uniformed in each of the rows of steam pipes. For example, the temperature differential between the air and the steam pipes in the first row will be the greatest and consequently a smaller heat exchange area is required than in the subsequent rows of steam pipes. Also, it will be noted that the pipes are staggered in each successive row with six pipes in the first and last row and five pipes in the intermediate row. The staggered pipes are used to insure that air passing in the heat exchange passage is exposed to a maximum amount of the heat exchange surfaces offered by the pipes and fins.

In operation of the apparatus the steam pressure at the pipes 26 is maintained at a selected constant. The air discharge temperature delivered at the outlet of the passages is maintained at some preselected level by adjusting the position of the gates 50 and 52 to maintain the proper mixture of heated and unheated air. The preset discharged temperature of the air is maintained even though there are variations in the inlet air temperature.

Various forms of controls may be used which are well known in the art and which in the drawings are indicated only schematically. By way of example, the air gates 50 and 52 may be under the control of motors which respond to temperatures to move the gates to selected positions. Also, the fan may be thermostatically controlled so that it operates only at temperatures below some predetermined level, for example, 62° F. The air gates 72 also may be moved by motors which are activated in any well known manner upon movement of the heat exchange air gates 50 to their fully closed position as illustrated in connection with zone C in FIG. 4. In operation, with the blower 14 operating, air flows into the inlet ends of the passages. As best seen in FIG. 4 in which each of the zones are being controlled separately, it will be noted that in zone A the gate 50 is fully open and that the gate 52 is fully closed. Under these conditions all of the air passing through zone A will be heated by the pipes 26. In contrast to this, the air gates in zone C are so arranged that air gate 52 is fully open whereas air gate 50 is fully closed. Under these conditions all of the exterior air being delivered by the fan will be moved through the bypass passage 46. To insure that the heat from the steam pipes 22 does not affect the bypass air, the air gate 72 also is in the closed position having been moved to that position in response to controls indicated at 80 responding to movement of the air gate 50 to its closed position.

Referring now to the central zone or zone B in FIG. 4, the air gates 50 and 52 have been moved through equal arcs to an intermediate position in which the transverse spacing indicated at 68 in FIG. 5 is equal to the width of the various passages. Under these conditions air delivered at the inlet ends of the passages 50 and 52 is such that approximately one half of the air is heated by the pipes 26 and the remaining air passes through the bypass passage. The plate 70 and the heat exchange means 24 offer the same degree of restriction to the passage of air so that the passage of air in adjacent passages is in proportion to the degree of opening of the gates. In the condition illustrated in zone B it will be noted that the air gate 72 is fully open to offer a minimum obstruction to the passage of air.

With several zones such as A, B and C controlled separately it is possible to use a single fan at the inlet side of the passages for the delivery of air and the zones may be controlled separately and independently of each other so that air discharged from the outlets of the zones A, B and C may be delivered through ducts, not shown, to separate buildings or rooms requiring different air treatment. On the other hand, when the air gates of all zones are operated simultaneously and identically and all of the treated air is being delivered to one location, the blower means for moving air may be located at the downstream side.

Apparatus for conditioning air has been provided in which adjacent passages are provided in which one of the passages contains heat exchange means and the other passage is unobstructed so that air passing through the pair of passages is under the control of air gates that are moved simultaneously in opposite directions to control the proportion of air passing through the respective passages. The simultaneous opening and closing of pairs of gates is such that the space between the gates for the passage of air is maintained constant for all positions of the gates between fully open and fully closed positions. This facilitates control and modulation of the air gates for the mixing of air so that for any given air velocity the volume remains constant. Constant air volume at any given velocity also is facilitated by making the heat exchange and bypass passages of uniform size and by providing a baffle or obstruction to air passage in the bypass passage which is equal to the obstruction offered by the heat exchange means. The maintenance of uniform pressure drops in adjacent passages insures that the air flow through the passages is in proportion to the position of the respective air gate associated with the passage.

The embodiments of the invention in which an exclusive property or privilege is claimed are defined as follows:

1. Apparatus for conditioning air comprising; a housing forming a pair of parallel passages having a common wall therebetween, means for moving air through said passages, heat exchange means disposed in one of said passages to form a heat exchange passage, the other of said passages forming a bypass passage, a pair of air gates controlling the opening and closing of said pair of passages, respectively, each of said air gates being supported for movement between open and closed positions at walls of said passage spaced from said common wall; and means connecting said pair of air gates together for simultaneous movement equal distances and in opposite directions with one of said air gates movable from an open to a closed position while the other of said air gates is moved from a closed toward an open position, said air gates being shaped to maintain a uniform opening therebetween for the passage of air from said pair of passages for all positions of said air gates.

2. The combination of claim 1 in which said air gates are located at the downstream side of said passages.

3. The combination of claim 1 in which said air gates are supported for swinging movement so that the spacing between a pair of gates remains constant upon swinging movement of said gates through equal arcs.

4. The combination of claim 1 in which said pair of passages have inlet ends having equal cross-sectional areas, and a perforated wall member disposed in said bypass passage to offer a resistance to the flow of air in said bypass passage equal to the resistance to air flow by said heat exchange means in said heat exchange passage.

5. The combination of claim 1 in which said common wall is thermally insulated.

6. The combination of claim 3 and further comprising means to close the inlet end of said heat exchange passage upon movement of the associated air gate to a closed position relative to said heat exchange passage.

7. The combination of claim 1 in which said pair of passages are equal in width and in which the opening between said air gates is equal to the width of one of said passages for all positions of said air gates.

8. The combination of claim 1 in which said heat exchange means comprise a plurality of spaced parallel tubes permitting the passage of air therebetween and further comprising a screen member in said bypass passage permitting the passage of air therethrough said parallel tubes and said secreen resisting air flow equally to maintain a uniform air flow in said pair of passages.

9. The combination of claim 8 in which said plurality of spaced parallel tubes are disposed vertically in a plurality of rows extending transversely to the direction of air movement in said heat exchange passage.

10. The combination of claim 9 in which said tubes are provided with uniformly spaced fins on their exterior to form a heat exchange surface and in which the tubes in the row closest to the upstream side of said air has less fins than the row of tubes at the downstream side of said passage.

11. The combination of claim 1 in which the outer part of said air gates are curved adjacent their unhinged edge.

12. The combination of claim 11 in which the air gates are curved so that a convex surface faces upstream in said air passage.

13. The combination of claim 1 in which said pair of passages forms a first set of passages and in which additional sets of such passages are disposed in parallel spaced relation to said first set.

14. The combination of claim 13 in which all of said sets of passages employ the same means for moving air.

15. The combination of claim 13 in which said air gates of each of said sets of passages are controlled independently of each other.

* * * * *